US005459290A

United States Patent [19]

Yamagishi

[11] Patent Number: 5,459,290

[45] Date of Patent: Oct. 17, 1995

[54] ACOUSTIC TRANSDUCER AND ACOUSTIC TRANSDUCING SYSTEM

[75] Inventor: Makoto Yamagishi, Tokyo, Japan

[73] Assignee: Sony Corporation, Tokyo, Japan

[21] Appl. No.: 740,583

[22] Filed: Aug. 5, 1991

[30] Foreign Application Priority Data

Aug. 21, 1990 [JP] Japan ..... 2-219416

[51] Int. Cl.[6] ..... H04R 25/00

[52] U.S. Cl. ..... 181/129; 381/183

[58] Field of Search ..... 181/129, 130, 181/131, 132, 133, 134, 135; 381/183, 187, 68.6

[56] References Cited

U.S. PATENT DOCUMENTS 1,586,140 5/1926 Bonnette ..... 181/129

4,523,661 6/1985 Scalzo et al. ..... 181/129

*Primary Examiner*—Khanh Dang

*Attorney, Agent, or Firm*—Ronald P. Kananen

[57] ABSTRACT

The present invention is directed to an acoustic transducer comprising acoustic transducing units respectively accommodated in cabinets which are attached in the vicinity of left and right ears and sound conduit tubes for conducting sounds emitted from the acoustic transducer units to the outside of the cabinets, wherein the inner diameter of the sound conduit tubes is selected to be shorter than the diameter of the acoustic transducing units, and end portions of the sound conduit tubes are placed outside the external auditory meatus of the left and right ears, thereby making external sounds audible during reproduction of sounds as well as reproducing sounds without causing a pressure. The present invention is also directed to an acoustic transducing system comprising acoustic reproducing apparatus which are supplied with audio signals and convert the audio signals to sounds for reproduction and an acoustic transducer composed of acoustic transducing units respectively accommodated in cabinets which are attached in the vicinity of left and right ears and sound conduit tubes for conducting sounds emitted from the acoustic transducer units to the outside of the cabinets, wherein the acoustic transducer transduces at least low frequency components of the audio signal supplied to the reproducing apparatus, thereby satisfactory reproducing sounds in a low frequency range without enlarging the system.

9 Claims, 5 Drawing Sheets

ACOUSTIC TRANSDUCER AND ACOUSTIC TRANSDUCING SYSTEM

BACKGROUND OF THE INVENTION

1. Field of the Invention

The present invention relates to an electroacoustic transducer for transducing sound and an acoustic transducing system employing such an acoustic transducer.

2. Description of the Prior Art

Acoustic transducers and acoustic transducing systems such as a headphone apparatus, an earphone apparatus, and so on have been proposed in which an acoustic signal (i.e., an audio signal) is supplied in the form of an electrical signal and the acoustic signal is transduced into a sound to thereby reproduce the sound.

Such an acoustic transducer is generally comprised of an acoustic transducing unit (i.e., a speaker unit) for transducing an acoustic signal to a sound. The acoustic transducer formed as a headphone apparatus is constructed such that a pair of acoustic transducer units are supported on a listener's two auricles in an opposing fashion.

An acoustic transducing system is generally comprised of a pair of left and right speakers used as an acoustic transducer for transducing an acoustic signal into a sound. Each of these speakers is comprised of a speaker unit serving as an acoustic transducing unit having a diaphragm and a speaker cabinet for housing the speaker unit such that the sound emanating surface thereof is opposed to the outside. In this acoustic transducing system, the speakers apparatus are disposed so as to oppose the listener from the front and the sound is reproduced by the speakers.

In the acoustic transducer constructed as the headphone apparatus as described above, since the acoustic transducing units constructing the acoustic transducer are opposed to the eardrums of the listener, a standing wave occurs between the acoustic transducing units and the eardrums. Because of the occurrence of the standing wave, the listener using such acoustic transducer feels pressure and a so-called lateralization.

Further, in the above acoustic transducer, since the the acoustic transducing units are supported so as to substantially close the external auditory meatus of the listener, it becomes difficult for the listener wearing this acoustic transducer to hear sound from the outside. As a consequence, when walking or driving a car while wearing this acoustic transducer, the listener cannot hear what is going on around the listener so that the listener cannot walk and drive a car safely.

In the above acoustic transducing system, in order to reproduce sound satisfactorily in a wide frequency band including a low frequency band, the speaker cabinet constructing the speaker units must be increased in volume and the diaphragms of the speaker units also must be increased in area. If the volume of the speaker cabinet and the area of the diaphragm are increased, then the acoustic transducer system is unavoidably enlarged in size.

Even in the acoustic transducing system in which the system is enlarged in size in order to satisfactorily reproduce sound in a wide frequency band, if an annoyance to the neighbors and the like are taken into consideration because of dwelling circumstances, and so forth, it is then frequently observed that sound cannot be reproduced with sufficient sound pressure.

OBJECTS AND SUMMARY OF THE INVENTION

Accordingly, it is an object of the present invention to provide an improved acoustic transducer and an improved acoustic transducing system in which the aforementioned shortcomings and disadvantages encountered with the prior art can be eliminated.

More specifically, it is an object of the present invention to provide an acoustic transducer which does not cause the listener to feel pressure and lateralization when constructed as a headphone or earphone.

It is another object of the present invention to provide an acoustic transducing system which can satisfactorily reproduce a sound over a wide frequency range including a low frequency band without enlarging the arrangement of the system or annoying the neighbors.

As a first aspect of the present invention, the present invention is directed to an acoustic transducer comprising acoustic transducing units respectively accommodated in cabinets which are attached in the vicinity of left and right ears and sound conduit tubes for conducting sounds emitted from the acoustic transducer units to the outside of the cabinets, wherein the inner diameter of the sound conduit tubes is selected to be shorter than the diameter of the acoustic transducing units, and end portions of the sound conduit tubes are placed outside the external auditory meatus of the left and right ears, thereby making external sounds audible during reproduction of sounds as well as reproducing sounds without causing a pressure.

In accordance with a second aspect of the present invention, the present invention is also directed to an acoustic transducing system comprising an acoustic reproducing apparatus which are supplied with audio signals and convert the audio signals to sounds for reproduction and an acoustic transducer composed of acoustic transducing units respectively accommodated in cabinets which are attached in the vicinity of left and right ears and sound conduit tubes for conducting sounds emitted from the acoustic transducer units to the outside of the cabinets, wherein the acoustic transducer transduces at least low frequency components of the audio signal supplied to the reproducing apparatus, thereby satisfactorily reproducing sounds in a low frequency range without enlarging the system.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

A first embodiment of the present invention will hereinafter be described with reference to FIGS. 1 through 7.

An acoustic transducer of the present embodiment will first be described with reference to FIGS. 1 through 5. The acoustic transducer of the present embodiment is an improvement of the acoustic transducer previously proposed by the assignee of the present application (see Japanese Patent Application No. 1-255797).

Figure 1:
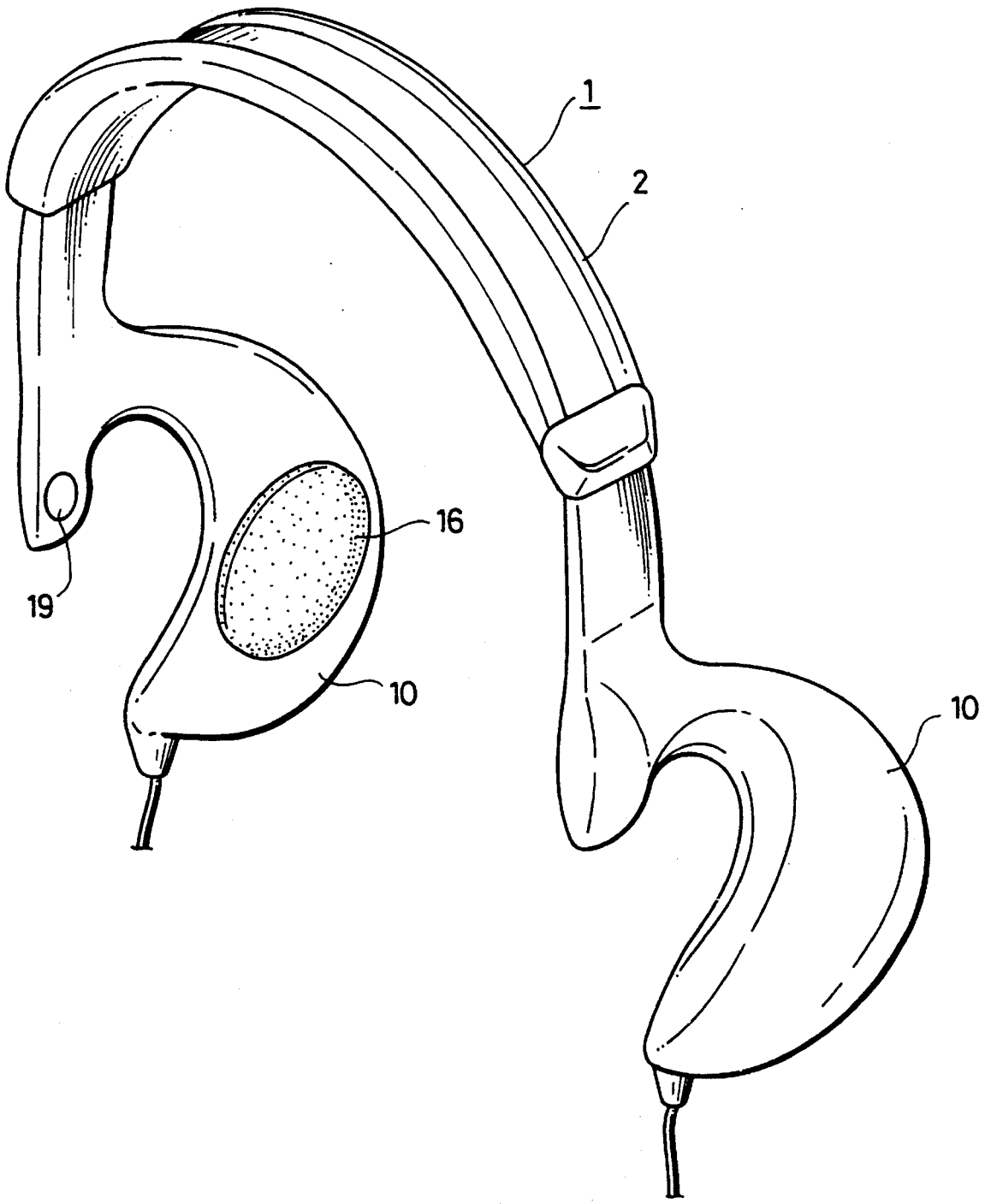
FIG. 1 is a perspective view showing a first embodiment of an acoustic transducer according to the present invention.

FIG. 1 illustrates an overall arrangement of the first embodiment of the acoustic transducer according to the present invention. As shown in FIG. 1, an acoustic transducer, generally designated by reference numeral 1, is composed of a belt 2 worn by the listener on the head and left and right cabinets 10 mounted at respective ends of the belt 2 to constitute a headphone. Each of the cabinets 10 houses elements and parts necessary for reproducing sound.

Figure 4:
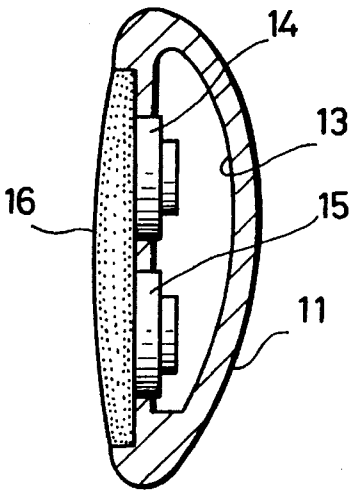
FIG. 4 is a cross-sectional view taken along the line IV—IV of FIG. 2.
Figure 3:
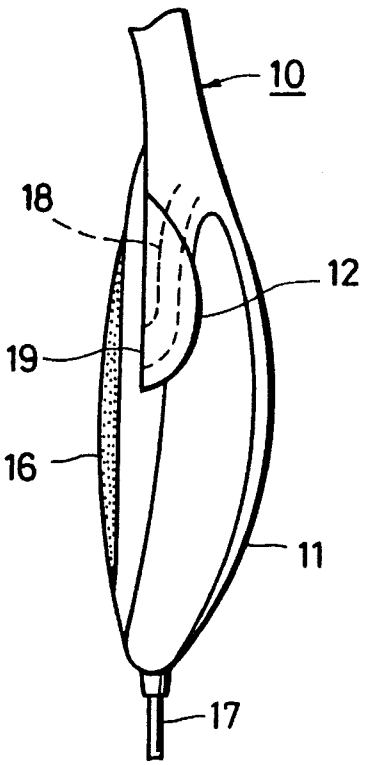
FIG. 3 is a front view taken through the arrow A direction of FIG. 2.
Figure 2:
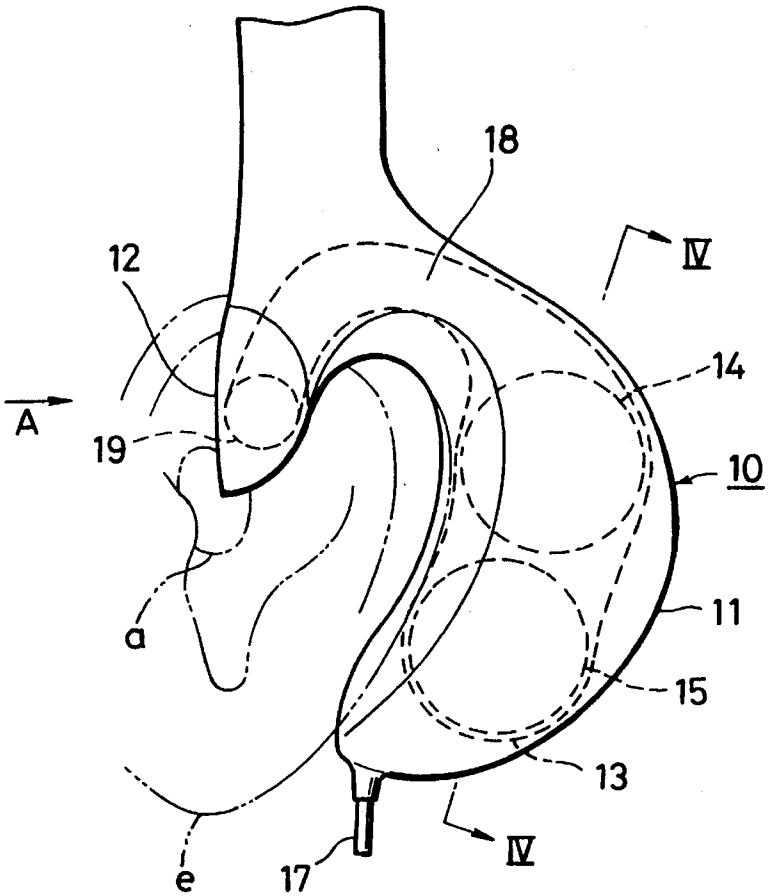
FIG. 2 is a side view of a main portion of the first embodiment.

More specifically, each of the left and right cabinets 10 is made of a synthetic resin and composed of a speaker unit housing portion 11 and a sound outputting portion 12 elongated forwardly from an upper portion of the speaker unit housing portion 11 as shown in FIGS. 2 to 4. The cabinet 10 is shaped such that, when the listener wears this acoustic transducer 1, the speaker unit housing portion 11 is located at the rear side of the auricle e of the listener while only the sound outputting portion 12 is placed on the auricle e. FIGS. 2 through 4 illustrate the left cabinet 10, and the right cabinet 10 has a configuration symmetrical to that of the left cabinet 10.

The speaker unit housing portion 11 has formed in its inside a cavity 13 in which speaker units 14, 15 forming the acoustic transducing units are housed. The two speaker units 14, 15 are circular and 30 mm in diameter. A pad 16 is attached to the inside of the two speaker units 14, 15 so that, when the listener wears the acoustic transducer 1, the pad 16 is brought in contact with the listener's head. The two speaker units 14, 15 are further connected to a signal line 17 led out to the outside from the cabinet 10 and the signal line 17 is connected to an amplifier or the like, whereby an acoustic signal is supplied to each of the two speaker units 14, 15. Thereby, the sound is reproduced.

The cavity 13 in which the speaker units 14, 15 are housed is connected to a sound conduit tube 18 of a hollow cylindrical configuration formed inside the cabinet 10. The cavity is communicated through the sound conduit tube 18 to a sound introducing opening portion 19 in the sound outputting portion 12 at its inside (opposite side of the plane shown in FIG. 2). Thus, sounds reproduced by the respective speaker units 14, 15 are outputted from the sound introducing opening portion 19 to the outside. The sound conduit tube 18 is a circular tube whose inner diameter is 10 mm and the sound introducing opening portion 19 is placed at the position (outside the exit a) facing the exit a of the external auditory meatus of the listener who wears the acoustic transducer 1. In this case, however, the exit a of the external auditory meatus must be prevented from being completely closed by the sound outputting portion 12 so that the listener can listen to sounds around him.

The listener who wears this acoustic transducer 1 can listen to the sound reproduced by the acoustic transducer 1 and use the same similarly to the ordinary headphone. Also, when the listener wears the acoustic transducer 1, since the exit a of the external auditory meatus of the listener is not closed, the listener can listen to sounds around him, which is very convenient for the listener. The acoustic transducer 1 is thus convenient. Further, since the speaker units 14, 15 are not directly opposed to the eardrums of the listener, a standing wave is not produced and accordingly the listener never feels pressure.

Particularly, in this embodiment, since each of the speaker units 14, 15 of the acoustic transducer 1 is arranged to have a diameter of 30 mm which is relatively large for the headphone and the sound conduit tube 18 also is arranged to have an inner diameter of 10 mm which is sufficiently smaller than the diameter of the speaker unit, a resonance frequency $f_0$ of the entirety of the acoustic transducer 1 is lowered by the sound conduit tube 18, which enables even the headphone apparatus to reproduce sound of a sufficiently low frequency band. Because the speaker unit has a relatively large diameter, the listener can sufficiently listen to the reproduced sound even by the sound introducing opening portion 19 disposed at the outside of the exit a of the external auditory meatus. If the inner diameter of the sound conduit tube 18 is substantially less than ½ of the diameter of the speaker unit, then the frequency characteristic of low band can be secured and the outer diameter of the sound conduit tube 18 (i.e., the inner diameter of the sound outputting portion 12) is relatively reduced; thereby, sound reproduced from those other than the acoustic transducer 1 is prevented from being disturbed. Furthermore, in this embodiment, since the two speaker units 14 and 15 are provided, the output level of the reproduced sound can be increased accordingly.

Figure 5:
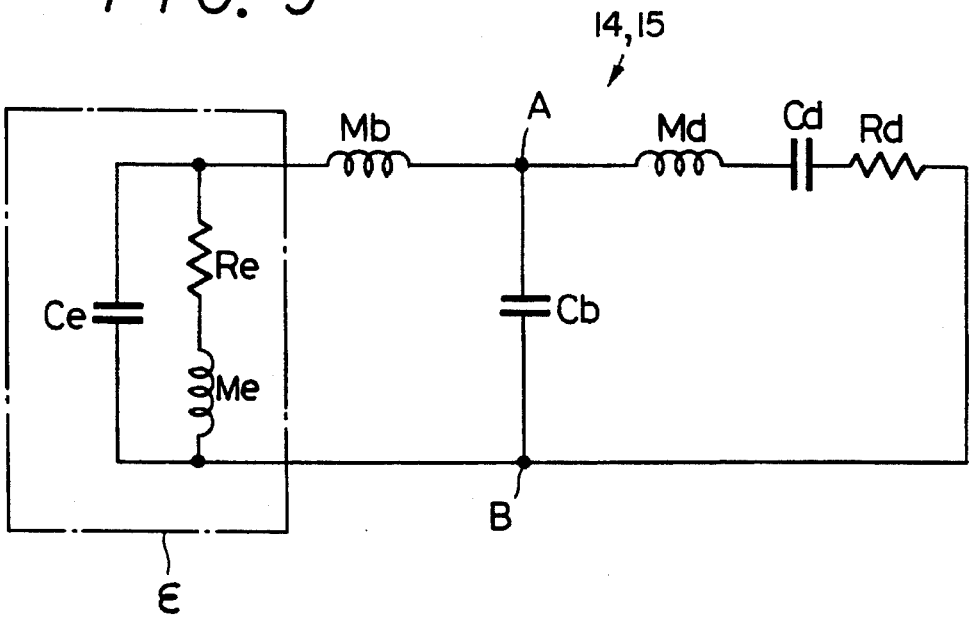
FIG. 5 is a circuit diagram used for explaining the first embodiment of the present invention.

FIG. 5 is a diagram of an acoustic circuit which equivalently illustrates the acoustic characteristic of the headphone apparatus forming the acoustic transducer 1. As shown in FIG. 5, equivalent mass Md, a compliance Cd and an acoustic resistance Rd with respect to the speaker units 14, 15 are connected in series and a compliance Cb within the cabinet 10 is connected to the former elements to thereby form a closed loop. One of the connection points between the series circuit formed of the equivalent mass Md, the compliance Cd, the acoustic resistance Rd and the compliance Cb as shown by A in FIG. 5 is connected through an equivalent mass Mb of the air within the sound conduit tube 18 to one end of an acoustic circuit $\epsilon$ of the external auditory meatus. The other of the connection points between the series circuit formed of the equivalent mass Md, the compliance Cd, the acoustic resistance Rd and the compliance Cb as shown by B in FIG. 5 is connected to the other end of the acoustic circuit $\epsilon$ of the external auditory meatus. In the acoustic circuit $\epsilon$ of the external auditory meatus, the equivalent mass Me, the compliance Ce and the acoustic resistance Re within the external auditory meatus form a closed loop. A connected portion of the compliance Ce and the acoustic resistance Re is connected to the equivalent mass Mb of the air within the sound conduit tube 18 as set forth above. Further, the connected portion between the compliance Ce and the equivalent mass Me is connected to the other of connection points between the series circuit formed of the equivalent mass Md, the compliance Cd, the acoustic resistance Rd and the compliance Cb as shown by B in FIG. 5.

This acoustic circuit derives the following resonance frequency $f_0$ of the headphone apparatus:

$$f_0 = 1/(2\pi\sqrt{(Md+Mb)Cd} \quad (1)$$

From the above equation (1), it is to be noted that the resultant resonance frequency $f_0$ is lower than the resonance frequency of the single speaker unit 14 or 15. Therefore, this headphone apparatus can satisfactorily reproduce sound over a wide frequency band involving the low frequency.

Figure 7:
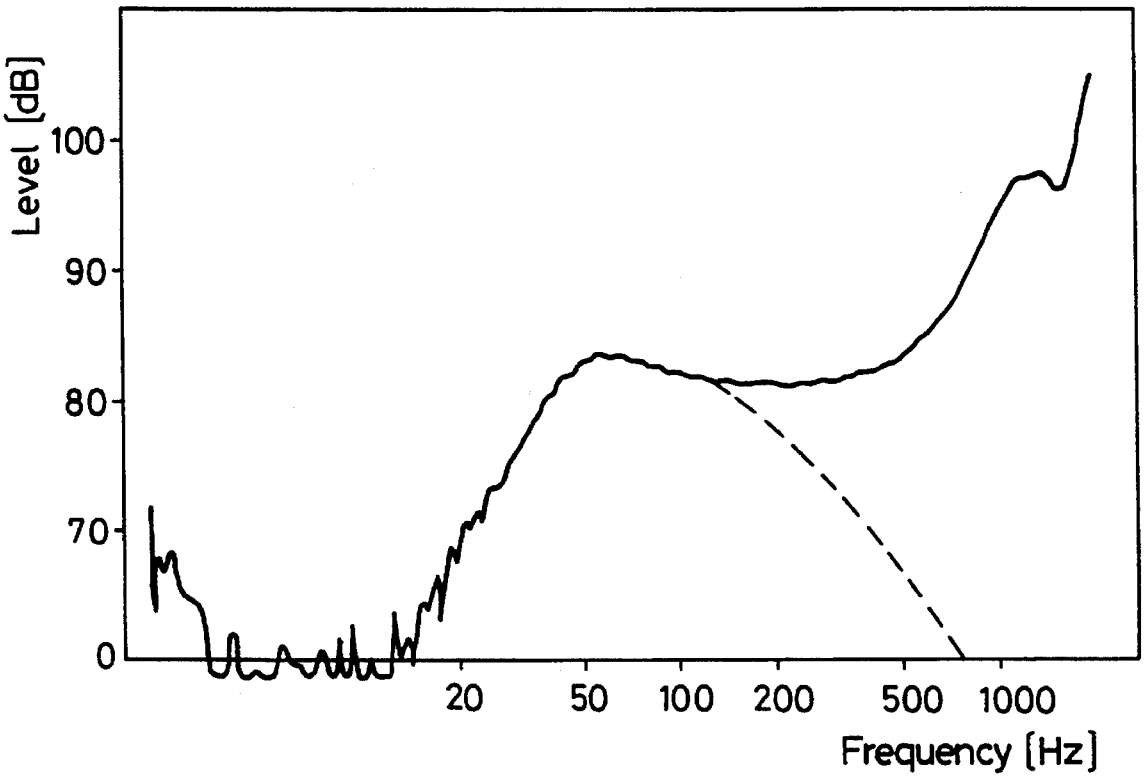
FIG. 7 is a graph of frequency characteristics to which references will be made in explaining the first embodiment of the present invention.

An acoustic transducing system using the acoustic transducer 1 will be described next with reference to FIGS. 6 and 7.

Figure 6:
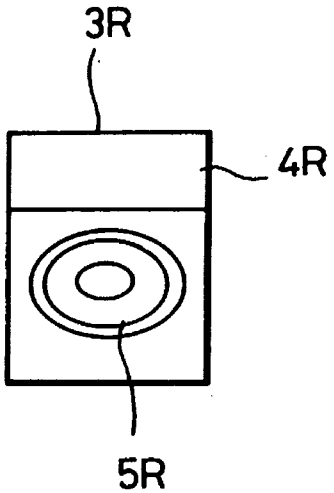
FIG. 6 is an explanatory diagram showing the configuration of the acoustic transducing system according to the first embodiment of the present invention.
Figure 6:
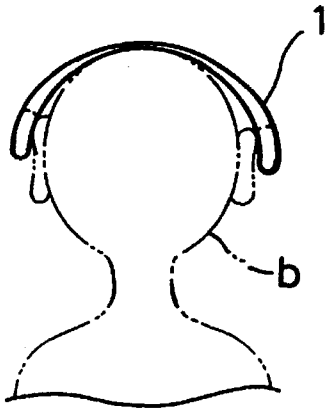
Figure 6:
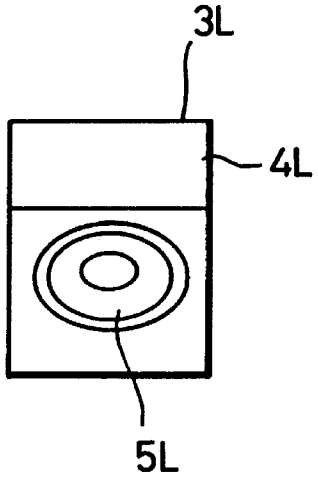

In this embodiment, as illustrated in FIG. 6, a listener b who wears the above-mentioned acoustic transducer 1 is seated at the position in which a sound field is formed by a pair of left and right speaker apparatus 3L, 3R forming the sound reproducing apparatus. The speaker apparatus 3L, 3R are of an ordinary box type in which speaker units 5L, 5R are disposed within speaker cabinets 4L, 4R. The left and right speaker apparatus 3L, 3R reproduce acoustic signals of all frequency bands from low to high frequency bands. Then, the acoustic transducer 1 constructed as the headphone is supplied with only a low frequency band signal extracted as an acoustic signal. That is, when the frequency characteristic of the acoustic signal outputted, for example, from the acoustic transducer 1 is represented in FIG. 7, the frequency band higher than about 200 Hz is cut off as shown by a broken line in FIG. 7 and the signal of only the frequency band lower than the cut-off frequency band is reproduced from the speaker units 14, 15 of the acoustic transducer 1.

Therefore, the listener b can listen to both of the sounds reproduced by the left and right speaker apparatuses 3L, 3R and the sound reproduced by the acoustic transducer 1 constructed as the headphone so that the low band of the sound reproduced by the left and right speaker apparatus 3L, 3R is intensified by the sound reproduced by the acoustic transducer 1. Accordingly, even when the speaker units 5L, 5R and the speaker cabinets 4L, 4R constituting the speaker apparatus 3L, 3R are too compact in size to reproduce sound of a low frequency band with sufficient sound pressure, the listener b can listen to powerful sound whose low band is intensified by the acoustic transducer 1.

Localization of reproduced sound is not influenced substantially by the sound of a low band lower than 200 Hz and localization of reproduced sound is determined by the high and middle bands of sound reproduced by the speaker apparatus 3L, 3R.

Next, a second embodiment of the present invention will be described with reference to FIG. 8.

Figure 8:
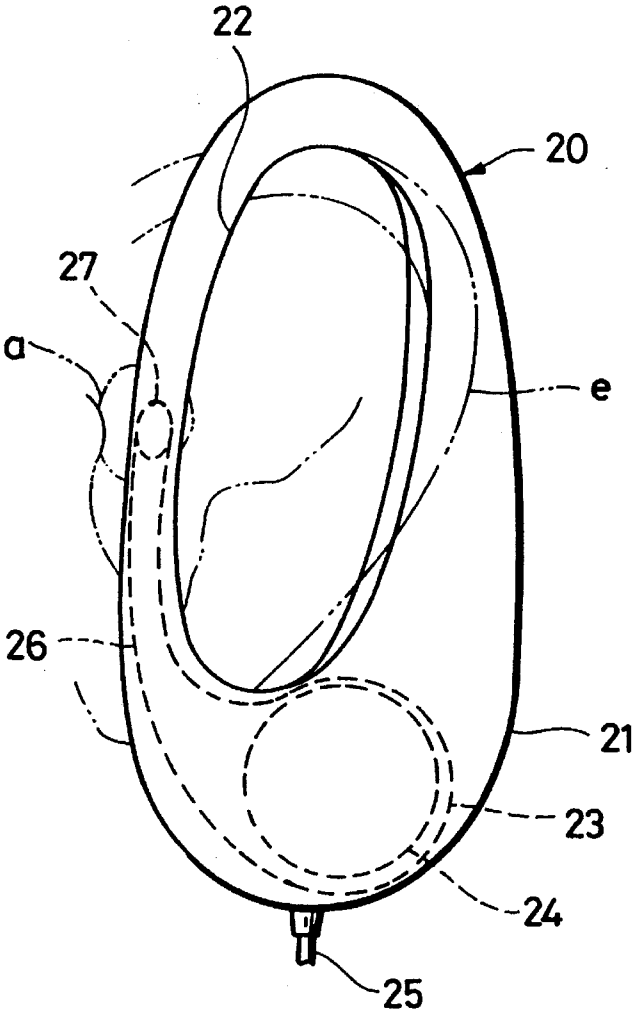
FIG. 8 is a side view illustrating a second embodiment of the acoustic transducer according to the present invention.

In the second embodiment, the acoustic transducers respectively attached the left and right auricles e are separated each other and constructed as illustrated in FIG. 8. More specifically, reference numeral 20 shown in FIG. 8 designates an acoustic transducer in general. This acoustic transducer 20 comprises a cabinet 21 made of synthetic resin and formed in a vertically long ellipse. In an upper portion of the cabinet 21, there is formed an elliptic throughhole 22 for inserting the auricle e therein. A speaker unit 24 is disposed in a cavity 23 formed in a lower portion of the cabinet 21. As the speaker unit 24, a circular one with a diameter of 30 mm is used for each of the left and right speaker units. The respective speaker units 24 are connected to signal lines 25 respectively lead out of the cabinets 21, and the signal lines 25 are connected to an amplifier or the like, whereby acoustic signals are supplied to the left and right speaker units 24 for sound reproduction. Incidentally, FIG. 8 illustrates the cabinet 21 on the left side, and the cabinet on the right side is formed symmetrically with the left side cabinet 21.

The cavity 23 in which the speaker unit 24 is accommodated communicates through a sound conduit tube 26 formed inside the cabinet 21 in a hollow cylindrical shape to a sound conducting opening 27 formed inside the cabinet 21 (on the side opposite to the surface shown in the drawing). Thus, a sound reproduced by the speaker unit 24 is outputted from the sound conducting opening 27 to the outside. The sound conducting opening 27 is arranged adjacent to the location of the throughhole 22. The inner diameter of the sound conduit tube 26 is selected to be 10 mm. The acoustic transducer 20 is arranged such that the sound conducting opening 27 is placed at a position facing the exit a of the external auditory meatus (outside the exit a) of the listener's auricle e when used by the listener. However, the respective parts are so selected that the sound conducting opening 27 and so on do not completely cover the exit a of the external auditory meatus to allow the listener to hear surrounding sounds.

Thus, the listener having the acoustic transducers 20 attached on his left and right auricles e, in the same manner as the first embodiment, can listen to the sounds reproduced from the acoustic transducers 20 in a manner similar to an ordinary headphone apparatus. Since the exit of the external auditory meatus is not closed by the sound conducting opening 27 or the like, the listener can hear surrounding sounds, thus providing a convenience. It is also possible to construct a transducing system in combination with speakers as the example shown in FIG. 6.

A third embodiment of the present invention will be described with reference to FIG. 9.

Figure 9:
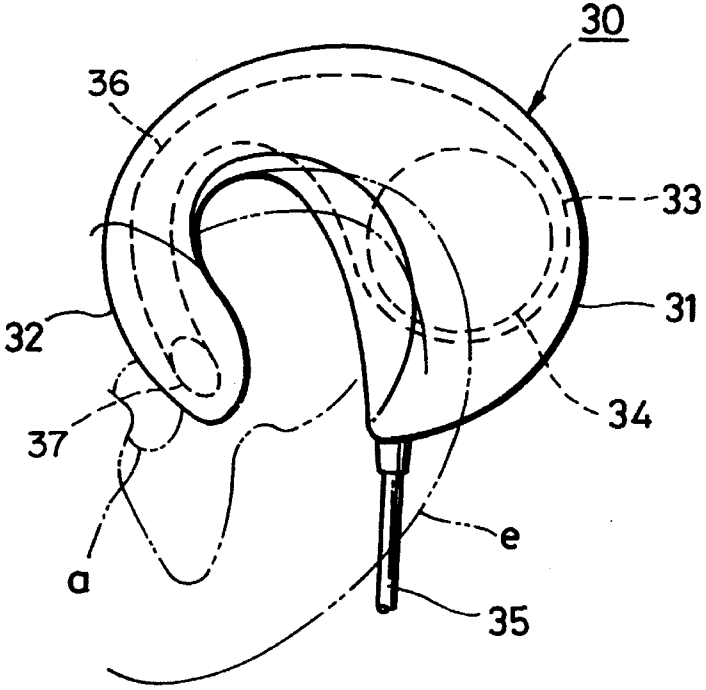
FIG. 9 is a side view illustrating a third embodiment of the the acoustic transducer according to the present invention.

The present embodiment also employs separate acoustic transducers to be attached on the left and right auricles e, as shown in FIG. 9. More specifically, reference numeral 30 in FIG. 9 designates an acoustic transducer in general. The acoustic transducer 30 has a cabinet 31, made of a synthetic resin, which is formed in a shape such that a major part of the cabinet 31 is located at the back of the auricle e of the listener while a sound outputting section 32 only is located at a position facing the exit a of the external auditory meatus when the listener has the acoustic transducer 30 on. Incidentally, FIG. 9 illustrates the cabinet 31 on the left side, and the cabinet on the right side is formed symmetrically with the left side cabinet 31.

A speaker unit 34 is disposed in a cavity 33 formed within the cabinet 31. A circular speaker with a diameter of 30 mm is used for each of the left and right speaker units 34. The respective speaker units 34 are connected to signal lines 35 respectively led out of the cabinets 31 to the outside, and the signal lines 35 are connected to an amplifier or the like, whereby acoustic signals are supplied to the left and right speaker units 34 and thus sounds are reproduced.

The cavity 33 in which the speaker unit 34 is accommodated communicates through a sound conduit tube 36 formed inside the cabinet 31 in a hollow cylindrical shape to a sound conducting opening 37 formed inside the sound outputting section 32 (on the side opposite to the surface shown in the drawing). Thus, a sound reproduced by the speaker unit 34 is outputted from the sound conducting opening 37 to the outside. The inner diameter of the sound conduit tube 36 is selected to be 10 mm. The acoustic transducer 30 is arranged such that the sound conducting opening 37 is placed at a position facing the exit a of the external auditory meatus (outside the exit a) of the listener's auricle e when used by the listener. However, the sound conducting opening 37 and so on are arranged so as not to completely cover the exit a of the external auditory meatus to allow the listener to hear surrounding sounds.

Thus, the listener having the acoustic transducers 30 attached on the left and right auricles, in the same manner as the first and second embodiments, can listen to sounds reproduced from the acoustic transducers 30 in a manner similar to an ordinary headphone. Since the exit of the external auditory meatus is not closed by the sound conducting opening 37 or the like, the listener can hear surrounding sounds, thus providing a convenience. It is also possible to construct a transducing system in combination with speaker apparatuses as the example shown in FIG. 6.

When the acoustic transducer of the present invention is used by the listener, the exits of his external auditory meatus are not closed completely so that the listener can hear surrounding sounds, thereby providing a convenience. Further, the acoustic transducer is employed for enhancing sounds in a low frequency range to thereby reproduce satisfactory sounds.

Having described the preferred embodiments of the invention with reference to the accompanying drawings, it is to be understood that the invention is not limited to those precise embodiments and that various changes and modifications thereof could be effected by one skilled in the art without departing from the spirit or scope of the novel concepts of the invention as defined in the appended claims.

I claim as my invention

1. An acoustic transducer comprising:

speaker units respectively accommodated in cabinets which are respectively attached in the vicinity of left and right ears of a listener, said cabinets each having a speaker unit housing portion and a sound outputting portion elongated forwardly from an upper portion of the speaker unit housing portion, said speaker unit housing portion being located at a rear side of an auricle of the listener when worn so that only the sound outputting portion is placed on the auricle, whereby an exit of an external auditory meatus of the listener is prevented from being completely closed by the sound outputting portion so that the listener can listen to sounds around him; and said sound outputting portion including sound conduit tubes for conducting sounds emitted from said speaker units to the outside of said cabinets, wherein the inner diameter of said sound conduit tubes is selected to be smaller than the diameter of said speaker units, and the end portions of said sound conduit tubes are placed outside the external auditory meatus of the left and right ears of the listener.

2. An acoustic transducer as set forth in claim 1, wherein each of said cabinets is formed as a vertically long ellipse defining the elliptic throughhole for inserting the auricle of a listener therein.

3. An acoustic transducer as set forth in claim 2, wherein each cavity which houses a speaker unit communicates though said sound conduit tube formed inside the cabinet in a hollow cylindrical shape to a sound conducting opening formed inside the cabinet so that sound reproduced by the speaker unit is outputted from the sound conducting opening to the outside.

4. An acoustic transducer as set forth in claim 3, wherein said sound conducting opening is arranged adjacent to the location of the throughhole at a position facing the exit of the external auditory meatus of the auricle of the listener when used by the listener, whereupon the sound conducting opening does not completely cover the exit of the external auditory meatus to allow the listener to hear surrounding sounds.

5. An acoustic transducer as set forth in claim 1, wherein said cabinet is formed in a shape such that a major part of the cabinet is located at a back of the auricle of the listener while a sound outputting section only is located at a position facing an exit of the external auditory meatus when the listener is wearing the acoustic transducer.

6. An acoustic transducer, comprising:

at least one cabinet;

means for securing said cabinet to a head of a wearer so that said cabinet communicates with an ear of said wearer;

said one cabinet having a speaker unit housing portion and a sound outputting portion, said speaker unit housing portion having a cavity for housing one or more speaker units therein, said cavity being connected to a sound conduit tube of a hollow configuration formed inside the cabinet so that the cavity communicates through the sound conduit tube to a sound introducing opening portion of the sound outputting portion at its inside so that sounds reproduced by the speaker units in the cavity are outputted from the sound introducing opening portion to the outside, the inner diameter of the sound conduit tube being selected to be smaller than the diameter of the speaker units, said sound outputting portion being constructed and positioned so that the external auditory meatus is prevented from being completely closed so that the wearer can listen to sounds around the wearer.

7. An acoustic transducer as set forth in claim 6 wherein said sound outputting portion is elongated forwardly from an upper portion of the speaker unit housing portion and is shaped such that, when the wearer wears the acoustic transducer, the speaker unit housing portion is located at the rear side of the auricle of the wearer while only the sound outputting portion is placed on the auricle.

8. An acoustic transducer as set forth in claim 6 wherein said cabinet is formed in a vertically long ellipse having, in an upper portion of the cabinet, an elliptic throughhole for inserting the auricle of the wearer therein, said cavity for said speaker unit being formed in a lower portion of the cabinet, said sound conducting opening arranged adjacent to the location of the throughhole.

9. An acoustic transducer as set forth in claim 6 wherein said cabinet is formed in a shape such that a major part of the cabinet is located at the back of the auricle of the wearer while the sound outputting section only is located at a position facing the exit of the external auditory meatus.

* * * * *